US008010353B2

(12) United States Patent
Kawashima et al.

(10) Patent No.: US 8,010,353 B2
(45) Date of Patent: Aug. 30, 2011

(54) AUDIO SWITCHING DEVICE AND AUDIO SWITCHING METHOD THAT VARY A DEGREE OF CHANGE IN MIXING RATIO OF MIXING NARROW-BAND SPEECH SIGNAL AND WIDE-BAND SPEECH SIGNAL

(75) Inventors: Takuya Kawashima, Ishikawa (JP); Hiroyuki Ehara, Kanagawa (JP)

(73) Assignee: PANASONIC Corporation, Osaka (JP)

( * ) Notice: Subject to any disclaimer, the term of this patent is extended or adjusted under 35 U.S.C. 154(b) by 1008 days.

(21) Appl. No.: 11/722,904

(22) PCT Filed: Jan. 12, 2006

(86) PCT No.: PCT/JP2006/300295

§ 371 (c)(1),
(2), (4) Date: Jun. 27, 2007

(87) PCT Pub. No.: WO2006/075663

PCT Pub. Date: Jul. 20, 2006

(65) Prior Publication Data

US 2010/0036656 A1 Feb. 11, 2010

(30) Foreign Application Priority Data

Jan. 14, 2005 (JP) ..... 2005-008084

(51) Int. Cl.
*G10L 19/14* (2006.01)
*G10L 19/00* (2006.01)

(52) U.S. Cl. ..... 704/225; 704/201; 704/500; 704/501

(58) Field of Classification Search ..... 704/225, 704/500, 501, 201
See application file for complete search history.

(56) References Cited

U.S. PATENT DOCUMENTS 5,432,859 A * 7/1995 Yang et al. ..... 381/94.3
5,699,479 A 12/1997 Allen et al.
5,978,759 A 11/1999 Tsushima et al.
6,349,197 B1 * 2/2002 Oestreich ..... 455/63.1
6,377,915 B1 * 4/2002 Sasaki ..... 704/206
(Continued)

FOREIGN PATENT DOCUMENTS

EP 0740428 10/1996
(Continued)

OTHER PUBLICATIONS

Valin et al., "Bandwidth Extension of Narrowband Speech for Low Bit-Rate Wideband Coding," http://people.xiph.org/~jm/papers/scw2000.pdf, 2000.*

(Continued)

*Primary Examiner* — Richemond Dorvil
*Assistant Examiner* — Douglas C Godbold
(74) *Attorney, Agent, or Firm* — Greenblum & Bernstein, P.L.C.

(57) ABSTRACT

There is disclosed a speech switching device capable of improving quality of a decoded signal. In the device, a weighted addition unit outputs a mixed signal of a narrow-band speech signal and a wide-band speech signal when switching the speech signal band. A mixing unit formed by an extended layer decoded speech amplifier and an adder mixes the narrow-band speech signal with the wide-band speech signal while changing the mixing ratio of the narrow-band speech signal and the wide-band speech signal as the time elapses, thereby obtaining a mixed signal. An extended layer decoded speech gain controller variably sets the degree of change of the mixing ratio by the time.

21 Claims, 9 Drawing Sheets

U.S. PATENT DOCUMENTS

| | | | | |
|---|---|---|---|---|
| 6,691,085 | B1 * | 2/2004 | Mikkola et al. | 704/228 |
| 6,732,075 | B1 * | 5/2004 | Omori et al. | 704/250 |
| 6,807,524 | B1 * | 10/2004 | Bessette et al. | 704/200.1 |
| 6,978,236 | B1 * | 12/2005 | Liljeryd et al. | 704/219 |
| 7,020,604 | B2 * | 3/2006 | Kuwaoka | 704/206 |
| 7,027,981 | B2 * | 4/2006 | Bizjak | 704/225 |
| 7,151,802 | B1 * | 12/2006 | Bessette et al. | 375/259 |
| 7,283,956 | B2 * | 10/2007 | Ashley et al. | 704/228 |
| 7,461,003 | B1 * | 12/2008 | Tanrikulu | 704/500 |
| 7,577,259 | B2 * | 8/2009 | Iwata | 381/61 |
| 7,613,604 | B1 * | 11/2009 | Malah et al. | 704/205 |
| 7,613,607 | B2 * | 11/2009 | Valve et al. | 704/225 |
| 2001/0027390 | A1 * | 10/2001 | Rotola-Pukkila et al. | 704/219 |
| 2001/0044712 | A1 | 11/2001 | Vainio et al. | |
| 2002/0128839 | A1 * | 9/2002 | Lindgren et al. | 704/258 |
| 2003/0093278 | A1 * | 5/2003 | Malah | 704/265 |
| 2003/0093279 | A1 * | 5/2003 | Malah et al. | 704/265 |
| 2005/0004793 | A1 | 1/2005 | Ojala et al. | |
| 2005/0010402 | A1 * | 1/2005 | Sung et al. | 704/219 |
| 2005/0010404 | A1 * | 1/2005 | Son et al. | 704/219 |
| 2005/0108004 | A1 | 5/2005 | Otani et al. | |
| 2005/0149339 | A1 * | 7/2005 | Tanaka et al. | 704/500 |
| 2005/0159943 | A1 * | 7/2005 | Zinser et al. | 704/219 |
| 2005/0163323 | A1 | 7/2005 | Oshikiri | |
| 2005/0252361 | A1 * | 11/2005 | Oshikiri | 84/605 |
| 2007/0277078 | A1 * | 11/2007 | Yamanashi et al. | 714/757 |

FOREIGN PATENT DOCUMENTS

| | | |
|---|---|---|
| JP | 8-248997 | 9/1996 |
| JP | 9-090992 | 4/1997 |
| JP | 9-258787 | 10/1997 |
| JP | 2000-206996 | 7/2000 |
| JP | 2000-261529 | 9/2000 |
| JP | 2003-323199 | 11/2003 |
| JP | 2004-101720 | 4/2004 |
| JP | 2004-272052 | 9/2004 |
| WO | 01/86635 | 11/2001 |
| WO | 03/104924 | 12/2003 |

OTHER PUBLICATIONS

Chennoukh et al., "Speech Enhancement Via Frequency Bandwidth Extension Using Line Spectral Frequencies," http://www.ece.umassd.edu/Faculty/acosta/ICASSP/Icassp_2001/MAIN/papers/pap1059. pdf, 2001.*

Oshikiri, M.; Ehara, H.; Yoshida, K.; , "A scalable coder designed for 10-kHz bandwidth speech," Speech Coding, 2002, IEEE Workshop Proceedings. , vol., No., pp. 111-113, Oct. 6-9, 2002 URL: http://ieeexplore.ieee.org/stamp/stamp.jsp?tp=&arnumber=1215741&isnumber=27344.*

Painter et al., "Perceptual Coding of Digital Audio," Proceedings of the IEEE, Vol. 88, No. 4, IEEE, Apr. 2000, pp. 451-513, XP011044355.

* cited by examiner

AUDIO SWITCHING DEVICE AND AUDIO SWITCHING METHOD THAT VARY A DEGREE OF CHANGE IN MIXING RATIO OF MIXING NARROW-BAND SPEECH SIGNAL AND WIDE-BAND SPEECH SIGNAL

TECHNICAL FIELD

The present invention relates to a speech switching apparatus and speech switching method that switch a speech signal band.

BACKGROUND ART

With a technology for coding a speech signal hierarchically, generally called scalable speech coding, if coded data of a particular layer is lost, the speech signal can still be decoded from coded data of another layer. Scalable coding includes a technique called band scalable speech coding. In band scalable speech coding, a processing layer that performs coding and decoding on a narrow-band signal, and a processing layer that performs coding and decoding in order to improve the quality and widen the band of a narrow-band signal, are used. Below, the former processing layer is referred to as a core layer, and the latter processing layer as an extended layer.

When band scalable speech coding is applied to speech data communications on a communication network in which the transmission band is not guaranteed and coded data may be partially lost or delayed, for example, the receiving side may be able to receive both core layer and extended layer coded data (core layer coded data and extended layer coded data), or may be able to receive only core layer coded data. It is therefore necessary for a speech decoding apparatus provided on the receiving side to switch an output decoded speech signal between a narrow-band decoded speech signal obtained from core layer coded data alone and a wide-band decoded speech signal obtained from both core layer and extended layer decoded data.

A method for switching smoothly between a narrow-band decoded speech signal and wide-band decoded speech signal, and preventing discontinuity of speech volume or discontinuity of the sense of the width of the band (band sensation), is described in Patent Document 1, for example. The speech switching apparatus described in this document coordinates the sampling frequency, delay, and phase of both signals (that is, the narrow-band decoded speech signal and wide-band decoded speech signal), and performs weighted addition of the two signals. In weighted addition, the two signals are added while changing the mixing ratio of the two signals by a fixed degree (increase or decrease) over time. Then, when the output signal is switched from a narrow-band decoded speech signal to a wide-band decoded speech signal, or from a wide-band decoded speech signal to a narrow-band decoded speech signal, weighted addition signal output is performed between narrow-band decoded speech signal output and wide-band decoded speech signal output. Patent Document 1: Unexamined Japanese Patent Publication No. 2000-352999

DISCLOSURE OF INVENTION

Problems to be Solved by the Invention

However, with the above conventional speech switching apparatus, since the degree of change of the mixing ratio used for weighted addition of the two signals is always the same, under certain circumstances a person listening to the decoded speech may experience a disagreeable sensation or a sense of fluctuation in the signal. For example, if speech switching is frequently performed in an interval in which a signal exhibiting constant background noise is included in the speech signal, a listener will tend to sense variation in power or band sensation associated with switching. There has consequently been a certain limit to improvements that can be made in sound quality.

It is therefore an object of the present invention to provide a speech switching apparatus and speech switching method capable of improving the quality of decoded speech.

Means for Solving the Problems

A speech switching apparatus of the present invention outputs a mixed signal in which a narrow-band speech signal and wide-band speech signal are mixed when switching the band of an output speech signal, and employs a configuration that includes a mixing section that mixes the narrow-band speech signal and the wide-band speech signal while changing the mixing ratio of the narrow-band speech signal and the wide-band speech signal over time, and obtains the mixed signal, and a setting section that variably sets the degree of change over time of the mixing ratio.

ADVANTAGEOUS EFFECT OF THE INVENTION

The present invention can switch smoothly between a narrow-band decoded speech signal and wide-band decoded speech signal, and can therefore improve the quality of decoded speech.

BEST MODE FOR CARRYING OUT THE INVENTION

An embodiment of the present invention will now be described in detail with reference to the accompanying drawings.

Figure 1:
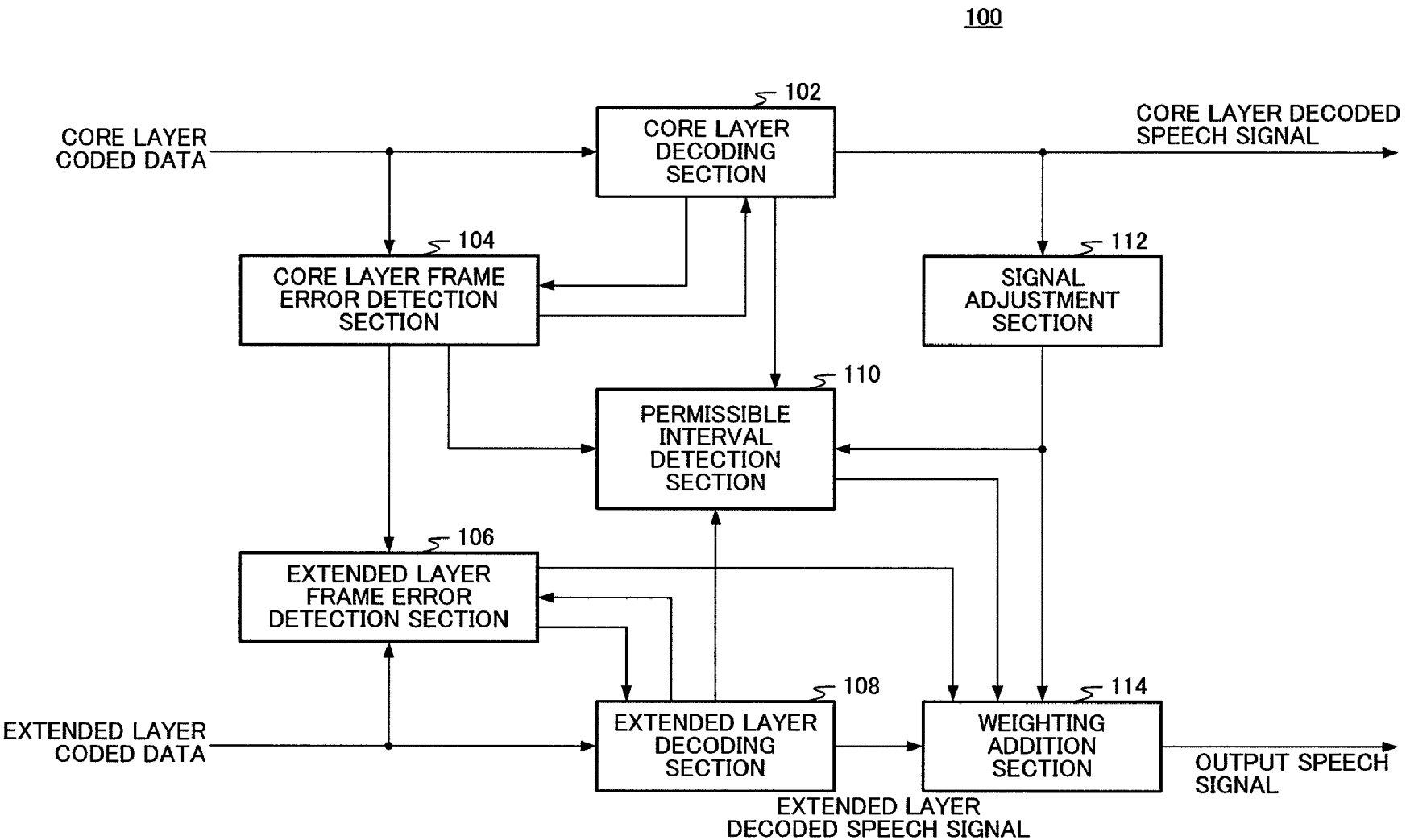
FIG. 1 is a block diagram showing the configuration of a speech decoding apparatus according to an embodiment of the present invention.

FIG. 1 is a block diagram showing the configuration of a speech decoding apparatus according to an embodiment of the present invention. Speech decoding apparatus 100 in FIG. 1 has a core layer decoding section 102, a core layer frame error detection section 104, an extended layer frame error detection section 106, an extended layer decoding section 108, a permissible interval detection section 110, a signal adjustment section 112, and a weighting addition section 114.

Core layer frame error detection section 104 detects whether or not core layer coded data can be decoded. Specifically, core layer frame error detection section 104 detects a core layer frame error. When a core layer frame error is detected, it is determined that core layer coded data cannot be decoded. The core layer frame error detection result is output to core layer decoding section 102 and permissible interval detection section 110.

A core layer frame error here denotes an error received during core layer coded data frame transmission, or a state in which most or all core layer coded data cannot be used for decoding for a reason such as packet loss in packet communication (for example, packet destruction on the communication path, packet non-arrival due to jitter, or the like).

Core layer frame error detection is implemented by having core layer frame error detection section 104 execute the following processing, for example. Core layer frame error detection section 104 may, for example, receive error information separately from core layer coded data, or may perform error detection using a CRC (Cyclic Redundancy Check) or the like added to core layer coded data, or may determine that core layer coded data has not arrived by the decoding time, or may detect packet loss or non-arrival. Alternatively, if a major error is detected by means of an error detection code contained in core layer coded data or the like in the course of core layer coded data decoding by core layer decoding section 102, core layer frame error detection section 104 obtains information to that effect from core layer decoding section 102.

Core layer decoding section 102 receives core layer coded data and decodes that core layer coded data. A core layer decoded speech signal generated by this decoding is output to signal adjustment section 112. The core layer decoded speech signal is a narrow-band signal. This core layer decoded speech signal may be used directly as final output. Core layer decoding section 102 outputs part of the core layer coded data, or a core layer LSP (Line Spectrum Pair), to permissible interval detection section 110. A core layer LSP is a spectrum parameter obtained in the course of core layer decoding. Here, a case in which core layer decoding section 102 outputs a core layer LSP to permissible interval detection section 110 is described by way of example, but another spectrum parameter obtained in the course of core layer decoding, or another parameter that is not a spectrum parameter obtained in the course of core layer decoding, may also be output.

If a core layer frame error is reported from core layer frame error detection section 104, or if a major error has been determined to be present by means of an error detection code contained in core layer coded data or the like in the course of core layer coded data decoding, core layer decoding section 102 performs linear predictive coefficient and excitation signal interpolation and so forth, using past coded information. By this means, a core layer decoded speech signal is continually generated and output. Also, if a major error is determined to be present by means of an error detection code contained in core layer coded data or the like in the course of core layer coded data decoding, core layer decoding section 102 reports information to that effect to core layer frame error detection section 104.

Extended layer frame error detection section 106 detects whether or not extended layer coded data can be decoded. Specifically, extended layer frame error detection section 106 detects an extended layer frame error. When an extended layer frame error is detected, it is determined that extended layer coded data cannot be decoded. The extended layer frame error detection result is output to extended layer decoding section 108 and weighted addition section 114.

An extended layer frame error here denotes an error received during extended layer coded data frame transmission, or a state in which most or all extended layer coded data cannot be used for decoding for a reason such as packet loss in packet communication.

Extended layer frame error detection is implemented by having extended layer frame error detection section 106 execute the following processing, for example. Extended layer frame error detection section 106 may, for example, receive error information separately from extended layer coded data, or may perform error detection using a CRC or the like added to extended layer coded data, or may determine that extended layer coded data has not arrived by the decoding time, or may detect packet loss or non-arrival. Alternatively, if a major error is detected by means of an error detection code contained in extended layer coded data or the like in the course of extended layer coded data decoding by extended layer decoding section 108, extended layer frame error detection section 106 obtains information to that effect from extended layer decoding section 108. Or, if a scalable speech coding method is used in which core layer information is essential for extended layer decoding, when a core layer frame error is detected, extended layer frame error detection section 106 determines that an extended layer frame error has been detected. In this case, extended layer frame error detection section 106 receives core layer frame error detection result input from core layer frame error detection section 104.

Extended layer decoding section 108 receives extended layer coded data and decodes that extended layer coded data. An extended layer decoded speech signal generated by this decoding is output to permissible interval detection section 110 and weighted addition section 114. The extended layer decoded speech signal is a wide-band signal.

If an extended layer frame error is reported from extended layer frame error detection section 106, or if a major error has been determined to be present by means of an error detection code contained in extended layer coded data or the like in the course of extended layer coded data decoding, extended layer decoding section 108 performs linear predictive coefficient and excitation signal interpolation and so forth, using past coded information. By this means, an extended layer decoded speech signal is generated and output as necessary. Also, if a major error is determined to be present by means of an error detection code contained in extended layer coded data or the like in the course of extended layer coded data decoding, extended layer decoding section 108 reports information to that effect to extended layer frame error detection section 106.

Signal adjustment section 112 adjusts a core layer decoded speech signal input from core layer decoding section 102. Specifically, signal adjustment section 112 performs up-sampling on the core layer decoded speech signal, and coordinates it with sampling frequency of the extended layer decoded speech signal. Signal adjustment section 112 also adjusts the delay and phase of the core layer decoded speech signal in order to coordinate the delay and phase with the extended layer decoded speech signal. A core layer decoded speech signal on which these processes have been carried out is output to permissible interval detection section 110 and weighted addition section 114.

Permissible interval detection section 110 analyzes a core layer frame error detection result input from core layer frame error detection section 104, a core layer decoded speech signal input from signal adjustment section 112, a core layer LSP input from core layer decoding section 102, and an extended layer decoded speech signal input from extended layer decoding section 108, and detects a permissible interval based on the result of the analysis. The permissible interval detection result is output to weighted addition section 114. Thus, a period in which the degree to which the mixing ratio of a core layer decoded speech signal and extended layer decoded speech signal is changed over time is made comparatively high can be limited to a permissible interval alone, and the timing at which the degree of change over time of the mixing ratio is changed can be controlled.

Here, a permissible interval is an interval in which the perceptual effect is small when the band of an output speech signal is changed—that is, an interval in which a change in the output speech signal band is unlikely to be perceived by a listener. Conversely, an interval other than a permissible interval among intervals in which a core layer decoded speech signal and extended layer decoded speech signal are generated is an interval in which a change in the output speech signal band is likely to be perceived by a listener.

Therefore, a permissible interval is an interval for which an abrupt change in the output speech signal band is permitted.

Permissible interval detection section 110 detects a silent interval, power fluctuation interval, sound quality change interval, extended layer minute-power interval, and so forth, as a permissible interval, and outputs the detection result to weighted addition section 114. The internal configuration of permissible interval detection section 110 and the processing for detecting a permissible interval are described in detail later herein.

Weighted addition section 114 serving as a speech switching apparatus switches the band of an output speech signal. When switching the output speech signal band, weighted addition section 114 outputs a mixed signal in which a core layer speech signal and extended layer speech signal are mixed as an output speech signal. The mixed signal is generated by performing weighted addition of a core layer decoded speech signal input from signal adjustment section 112 and an extended layer decoded speech signal input from extended layer decoding section 108. That is to say, the mixed signal is the weighting sum of the core layer decoded speech signal and extended layer decoded speech signal.

Figure 5:
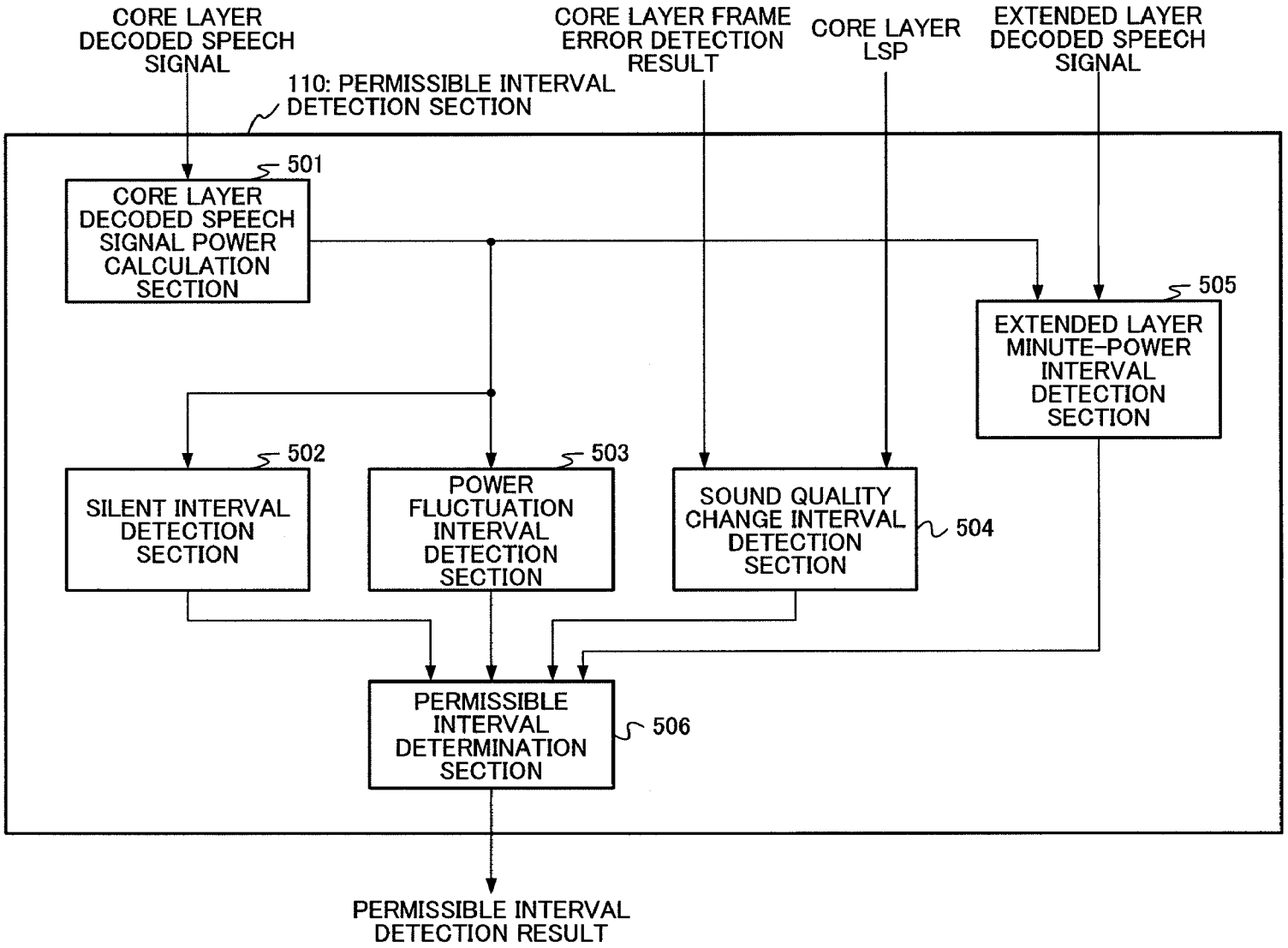
FIG. 5 is a block diagram showing the internal configuration of a permissible interval detection section according to an embodiment of the present invention.

FIG. 5 is a block diagram showing the internal configuration of permissible interval detection section 110. Permissible interval detection section 110 has a core layer decoded speech signal power calculation section 501, a silent interval detection section 502, a power fluctuation interval detection section 503, a sound quality change interval detection section 504, an extended layer minute-power interval detection section 505, and a permissible interval determination section 506.

Core layer decoded speech signal power calculation section 501 has a core layer decoded speech signal from core layer decoding section 102 as input, and calculates core layer decoded speech signal power Pc(t) in accordance with Equation (1) below.

(Equation 1)

$$Pc(t) = \sum_{i=1}^{L_FRAME} Oc(i) * Oc(i) \quad [1]$$

Here, t denotes the frame number, Pc(t) denotes the power of a core layer decoded speech signal in frame t, L_FRAME denotes the frame length, i denotes the sample number, and Oc(i) denotes the core layer decoded speech signal.

Core layer decoded speech signal power calculation section 501 outputs core layer decoded speech signal power Pc(t) obtained by calculation to silent interval detection section 502, power fluctuation interval detection section 503, and extended layer minute-power interval detection section 505. Silent interval detection section 502 detects a silent interval using core layer decoded speech signal power Pc(t) input from core layer decoded speech signal power calculation section 501, and outputs the obtained silent interval detection result to permissible interval determination section 506. Power fluctuation interval detection section 503 detects a power fluctuation interval using core layer decoded speech signal power Pc(t) input from core layer decoded speech signal power calculation section 501, and outputs the obtained power fluctuation interval detection result to permissible interval determination section 506. Sound quality change interval detection section 504 detects a sound quality change interval using a core layer frame error detection result input from core layer frame error detection section 104 and a core layer LSP input from core layer decoding section 102, and outputs the obtained sound quality change interval detection result to permissible interval determination section 506. Extended layer minute-power interval detection section 505 detects an extended layer minute-power interval using an extended layer decoded speech signal input from extended layer decoding section 108, and outputs the obtained extended layer minute-power interval detection result to permissible interval determination section 506. Based on the silent interval detection section 502, power fluctuation interval detection section 503, sound quality change interval detection section 504, and extended layer minute-power interval detection section 505 detection results, permissible interval determination section 506 determines whether or not a silent interval, power fluctuation interval, sound quality change interval, or extended layer minute-power interval has been detected. That is to say, permissible interval determination section 506 determines whether or not a permissible interval has been detected, and outputs a permissible interval detection result as the determination result.

Figure 6:
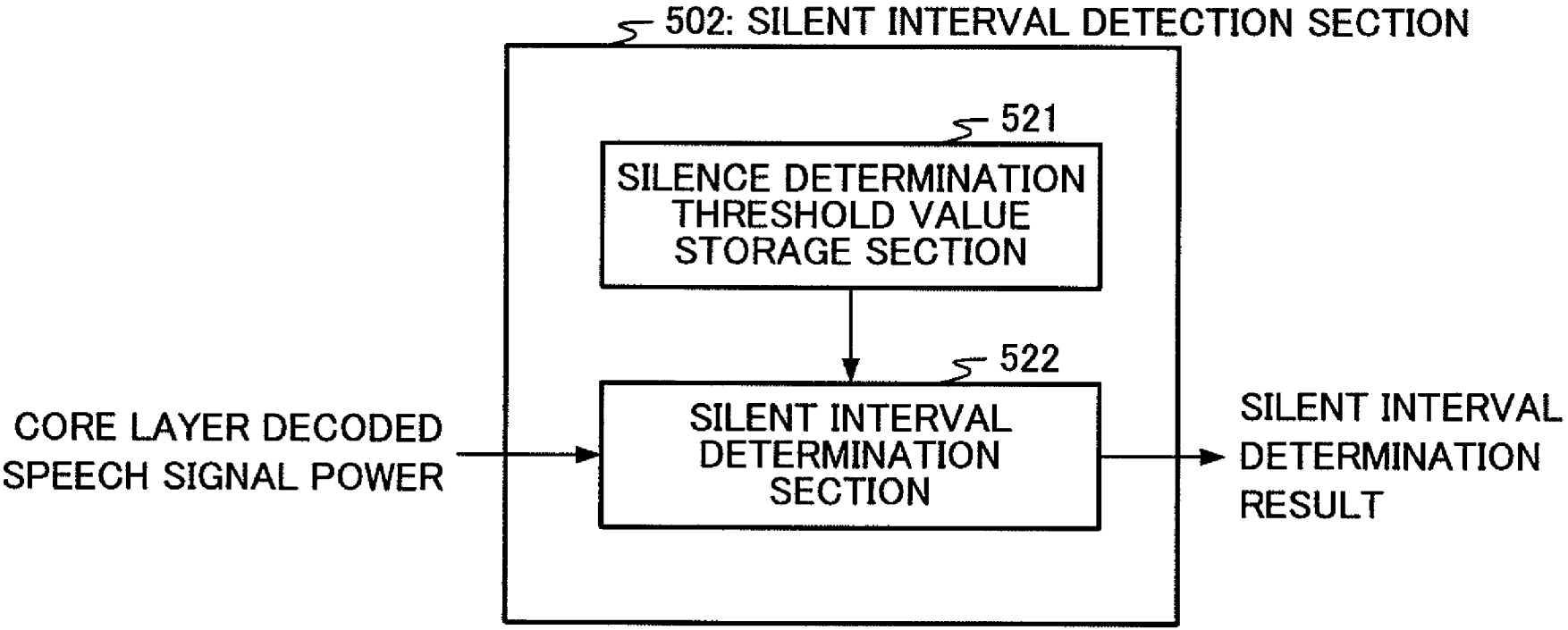
FIG. 6 is a block diagram showing the internal configuration of a silent interval detection section according to an embodiment of the present invention.

FIG. 6 is a block diagram showing the internal configuration of silent interval detection section 502.

A silent interval is an interval in which core layer decoded speech signal power is extremely small. In a silent interval, even if extended layer decoded speech signal gain (in other words, the mixing ratio of a core layer decoded speech signal and extended layer decoded speech signal) is changed rapidly, that change is difficult to perceive. A silent interval is detected by detecting that core layer decoded speech signal power is at or below a predetermined threshold value. Silent interval detection section 502, which performs such detection, has a silence determination threshold value storage section 521 and a silent interval determination section 522.

Silence determination threshold value storage section 521 stores a threshold value $\epsilon$ necessary for silent interval determination, and outputs threshold value $\epsilon$ to silent interval determination section 522. Silent interval determination section 522 compares core layer decoded speech signal power Pc(t) input from core layer decoded speech signal power calculation section 501 with threshold value $\epsilon$, and obtains a silent interval determination result d(t) in accordance with Equation (2) below. As a permissible interval includes a silent interval, the silent interval determination result is here represented by d(t), the same as a permissible interval detection result. Silent interval determination section 522 outputs silent interval determination result d(t) to permissible interval determination section 506.

(Equation 2)

$$d(t) = \begin{cases} 1, & Pc(t) < \varepsilon \\ 0, & \text{etc.} \end{cases} \quad [2]$$

Figure 7:
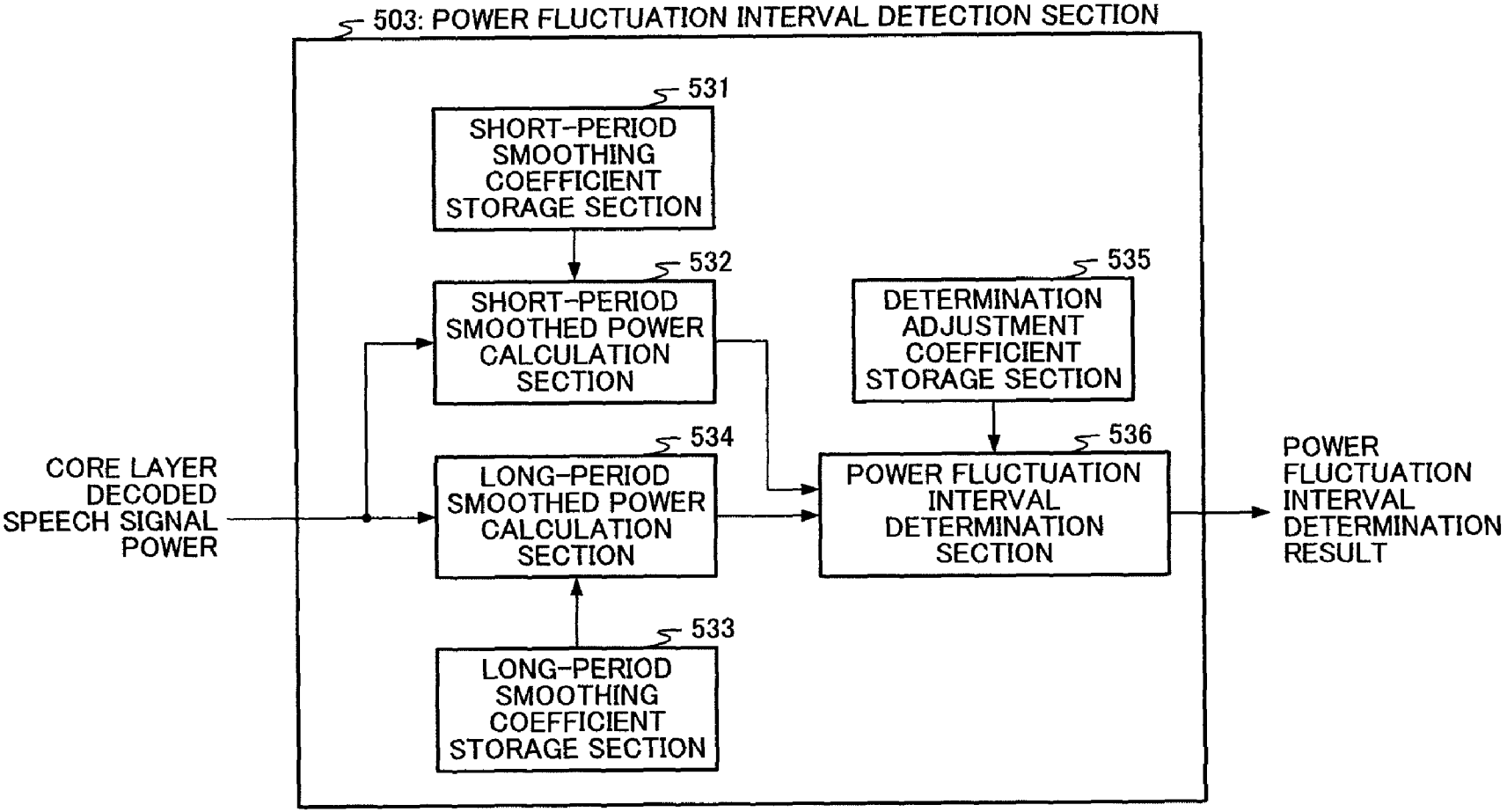
FIG. 7 is a block diagram showing the internal configuration of a power fluctuation interval detection section according to an embodiment of the present invention.

FIG. 7 is a block diagram showing the internal configuration of power fluctuation interval detection section 503.

A power fluctuation interval is an interval in which the power of a core layer decoded speech signal (or extended layer decoded speech signal) fluctuates greatly. In a power fluctuation interval, a certain amount of change (for example, a change in the tone of an output speech signal, or a change in band sensation) is unlikely to be perceived aurally, or even if perceived, does not give the listener a disagreeable sensation. Therefore, even if extended layer decoded speech signal gain (in other words, the mixing ratio of a core layer decoded speech signal and extended layer decoded speech signal) is changed rapidly, that change is difficult to perceive. A power fluctuation interval is detected by detecting that a comparison of the difference or ratio between short-period smoothed power and long-period smoothed power of a core layer decoded speech signal (or extended layer decoded speech signal) with a predetermined threshold value shows the difference or ratio to be at or above the predetermined threshold value. Power fluctuation interval detection section 503, which performs such detection, has a short-period smoothing coefficient storage section 531, a short-period smoothed power calculation section 532, a long-period smoothing coefficient storage section 533, a long-period smoothed power calculation section 534, a determination adjustment coefficient storage section 535, and a power fluctuation interval determination section 536.

Short-period smoothing coefficient storage section 531 stores a short-period smoothing coefficient α, and outputs short-period smoothing coefficient α to short-period smoothed power calculation section 532. Using this short-period smoothing coefficient α and core layer decoded speech signal power Pc(t) input from core layer decoded speech signal power calculation section 501, short-period smoothed power calculation section 532 calculates short-period smoothed power Ps(t) of core layer decoded speech signal power Pc(t) in accordance with Equation (3) below. Short-period smoothed power calculation section 532 outputs calculated core layer decoded speech signal power Pc(t) short-period smoothed power Ps(t) to power fluctuation interval determination section 536.

$$Ps(t)=\alpha*Ps(t)+(1-\alpha)*Pc(t) \quad \text{(Equation 3)}$$

Long-period smoothing coefficient storage section 533 stores a long-period smoothing coefficient β, and outputs long-period smoothing coefficient β to long-period smoothed power calculation section 534. Using this long-period smoothing coefficient β and core layer decoded speech signal power Pc(t) input from core layer decoded speech signal power calculation section 501, long-period smoothed power calculation section 534 calculates long-period smoothed power Pl(t) of core layer decoded speech signal power Pc(t) in accordance with Equation (4) below. Long-period smoothed power calculation section 534 outputs calculated core layer decoded speech signal power Pc(t) long-period smoothed power Pl(t) to power fluctuation interval determination section 536. The relationship between above short-period smoothing coefficient α and long-period smoothing coefficient β is: $0.0<\alpha<\beta<1.0$.

$$Pl(t)=\beta*Pl(t)+(1-\beta)*Pc(t) \quad \text{(Equation 4)}$$

Here, the relationship between short-period smoothing coefficient α and long-period smoothing coefficient β is: $0.0<\alpha<\beta<1.0$.

Determination adjustment coefficient storage section 535 stores an adjustment coefficient γ for determining a power fluctuation interval, and outputs adjustment coefficient γ to power fluctuation interval determination section 536. Using this adjustment coefficient γ, short-period smoothed power Ps(t) input from short-period smoothed power calculation section 532, and long-period smoothed power Pl(t) input from long-period smoothed power calculation section 534, power fluctuation interval determination section 536 obtains a power fluctuation interval determination result d(t). As a permissible interval includes a power fluctuation interval, the power fluctuation interval determination result is here represented by d(t), the same as a permissible interval detection result. Power fluctuation interval determination section 536 outputs power fluctuation interval determination result d(t) to permissible interval determination section 506.

(Equation 5)

$$d(t) = \begin{cases} 1, & Ps(t) > \gamma * Pl(t) \\ 0, & \text{etc.} \end{cases} \quad [5]$$

Here, a power fluctuation interval is detected by comparing short-period smoothed power with long-period smoothed power, but may also be detected by taking the result of a comparison with the power of the preceding and succeeding frames (or subframes), and determining that the amount of change in power is greater than or equal to a predetermined threshold value. Alternatively, a power fluctuation interval may be detected by determining the onset of a core layer decoded speech signal (or extended layer decoded speech signal).

Figure 8:
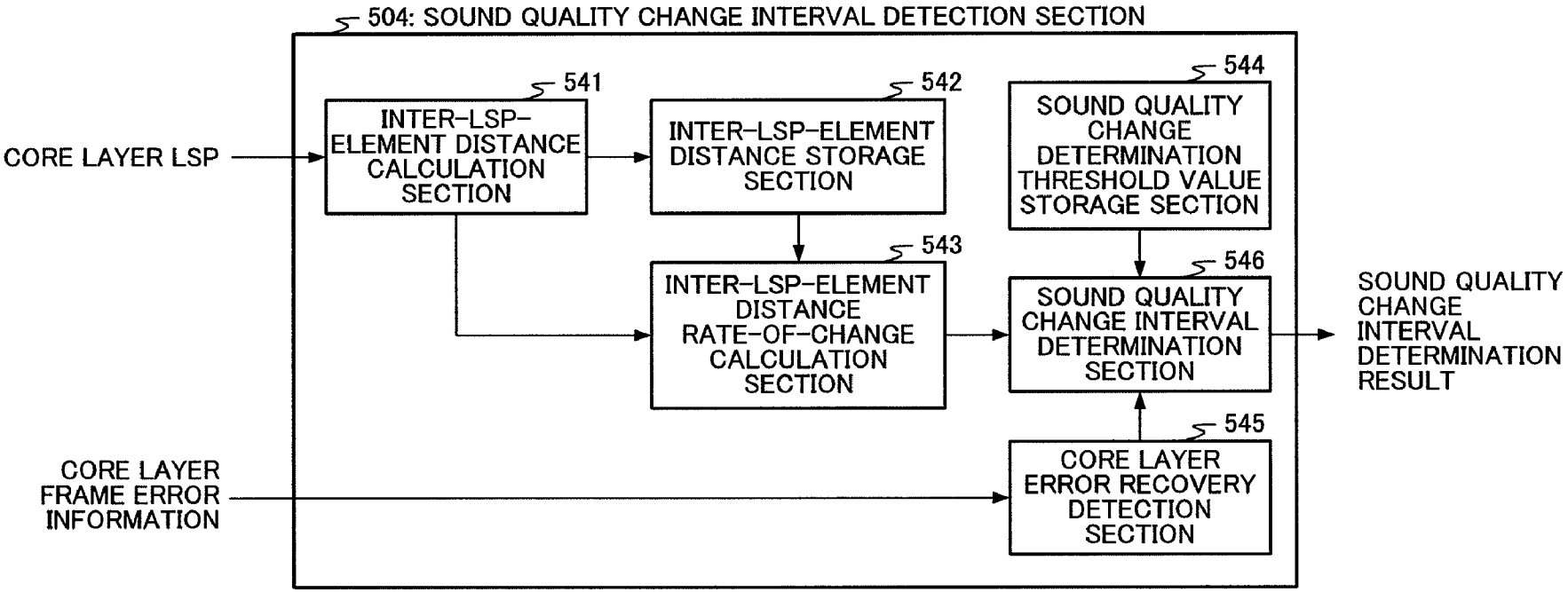
FIG. 8 is a block diagram showing the internal configuration of a sound quality change interval detection section according to an embodiment of the present invention.

FIG. 8 is a block diagram showing the internal configuration of sound quality change interval detection section 504.

A sound quality change interval is an interval in which the sound quality of a core layer decoded speech signal (or extended layer decoded speech signal) fluctuates greatly. In a sound quality change interval, a core layer decoded speech signal (or extended layer decoded speech signal) itself comes to be in a state in which temporal continuity is lost audibly. In this case, even if extended layer decoded speech signal gain (in other words, the mixing ratio of a core layer decoded speech signal and extended layer decoded speech signal) is changed rapidly, that change is difficult to perceive. A sound quality change interval is detected by detecting a rapid change in the type of background noise signal included in a core layer decoded speech signal (or extended layer decoded speech signal). Alternatively, a sound quality change interval is detected by detecting a change in a core layer coded data spectrum parameter (for example, LSP). To detect an LSP change, for example, the sum of distances between past LSP elements and present LSP elements is compared with a predetermined threshold value, and that sum of distances is detected to be greater than or equal to the threshold value. Sound quality change interval detection section 504, which performs such detection, has an inter-LSP-element distance calculation section 541, an inter-LSP-element distance storage section 542, an inter-LSP-element distance rate-of-change calculation section 543, a sound quality change determination threshold value storage section 544, a core layer error recovery detection section 545, and a sound quality change interval determination section 546.

Using a core layer LSP input from core layer decoding section 102, inter-LSP-element distance calculation section 541 calculates inter-LSP-element distance dlsp(t) in accordance with Equation (6) below.

(Equation 6)

$$dlsp(t) = \sum_{m=2}^{M} (lsp[m] - lsp[m-1])^2 \quad [6]$$

Inter-LSP-element distance dlsp(t) is output to inter-LSP-element distance storage section 542 and inter-LSP-element distance rate-of-change calculation section 543.

Inter-LSP-element distance storage section 542 stores inter-LSP-element distance dlsp(t) input from inter-LSP-element distance calculation section 541, and outputs past (one frame previous) inter-LSP-element distance dlsp(t−1) to inter-LSP-element distance rate-of-change calculation section 543. Inter-LSP-element distance rate-of-change calculation section 543 calculates the inter-LSP-element distance rate of change by dividing inter-LSP-element distance dlsp(t) by past inter-LSP-element distance dlsp(t−1). The calculated inter-LSP-element distance rate of change is output to sound quality change interval determination section 546.

Sound quality change determination threshold value storage section 544 stores a threshold value A necessary for sound quality change interval determination, and outputs threshold value A to sound quality change interval determination section 546. Using this threshold value A and the inter-LSP-element distance rate of change input from inter-LSP-element distance rate-of-change calculation section 543, sound quality change interval determination section 546 obtains sound quality change interval determination result d(t) in accordance with Equation (7) below.

(Equation 7)

$$d(t) = \begin{cases} 1, & \frac{dlsp(t)}{dlsp(t-1)} < 1/A \text{ or } \frac{dlsp(t)}{dlsp(t-1)} > A \\ 0, & \text{etc.} \end{cases} \quad [7]$$

Here, lsp denotes the core layer LSP coefficients, M denotes the core layer linear prediction coefficient analysis order, m denotes the LSP element number, and dlsp indicates the distance between adjacent elements.

As a permissible interval includes a power fluctuation interval, the sound quality change interval determination result is here represented by d(t), the same as a permissible interval detection result. Sound quality change interval determination section 546 outputs sound quality change interval determination result d(t) to permissible interval determination section 506.

When core layer error recovery detection section 545 detects that recovery from a frame error (normal reception) has been achieved based on a core layer frame error detection result input from core layer frame error detection section 104, core layer error recovery detection section 545 reports this to sound quality change interval determination section 546, and sound quality change interval determination section 546 determines a predetermined number of frames after recovery to be a sound quality change interval. That is to say, a predetermined number of frames after interpolation processing has been performed on a core layer decoded speech signal due to a core layer frame error are determined to be a sound quality change interval.

Figure 9:
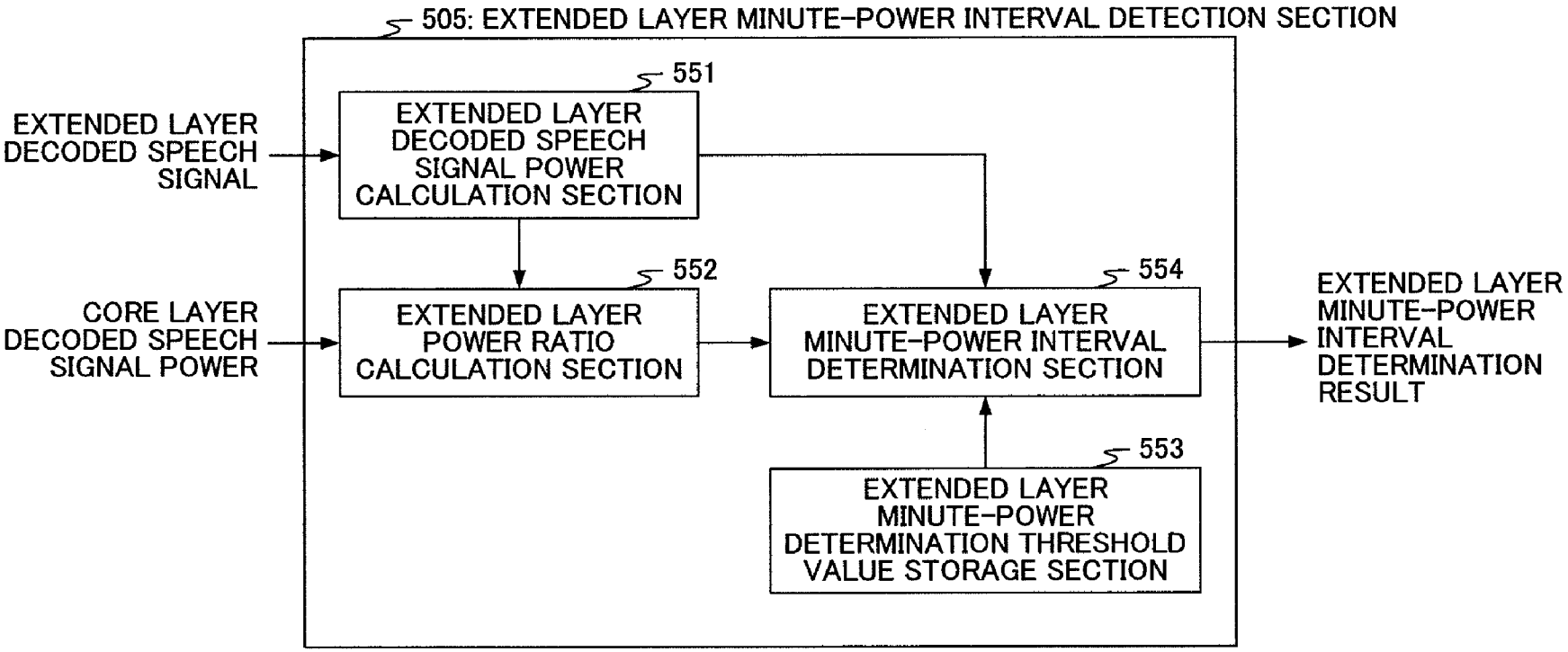
FIG. 9 is a block diagram showing the internal configuration of an extended layer minute-power interval detection section according to an embodiment of the present invention.

FIG. 9 is a block diagram showing the internal configuration of extended layer minute-power interval detection section 505.

An extended layer minute-power interval is an interval in which extended layer decoded speech signal power is extremely small. In an extended layer minute-power interval, even if the band of an output speech signal is changed rapidly, that change is unlikely to be perceived. Therefore, even if extended layer decoded speech signal gain (in other words, the mixing ratio of a core layer decoded speech signal and extended layer decoded speech signal) is changed rapidly, that change is difficult to perceive. An extended layer minute-power interval is detected by detecting that extended layer decoded speech signal power is at or below a predetermined threshold value. Alternatively, an extended layer minute-power interval is detected by detecting that the ratio of extended layer decoded speech signal power to core layer decoded speech signal power is at or below a predetermined threshold value. Extended layer minute-power interval detection section 505, which performs such detection, has an extended layer decoded speech signal power calculation section 551, an extended layer power ratio calculation section 552, an extended layer minute-power determination threshold value storage section 553, and an extended layer minute-power interval determination section 554.

Using an extended layer decoded signal input from extended layer decoding section 108, extended layer decoded speech signal power calculation section 551 calculates extended layer decoded speech signal power Pe(t) in accordance with Equation (8) below.

(Equation 8)

$$Pe(t) = \sum_{i=1}^{L_FRAME} Oe(i) * Oe(i) \quad [8]$$

Here, Oe(i) denotes an extended layer decoded speech signal, and Pe(t) denotes extended layer decoded speech signal power. Extended layer decoded speech signal power Pe(t) is output to extended layer power ratio calculation section 552 and extended layer minute-power interval determination section 554.

Extended layer power ratio calculation section 552 calculates the extended layer power ratio by dividing this extended layer decoded speech signal power Pe(t) by core layer decoded speech signal power Pc(t) input from core layer decoded speech signal power calculation section 501. The extended layer power ratio is output to extended layer minute-power interval determination section 554.

Extended layer minute-power determination threshold value storage section 553 stores threshold values B and C necessary for extended layer minute-power interval determination, and outputs threshold values B and C to extended layer minute-power interval determination section 554. Using extended layer decoded speech signal power Pe(t) input from extended layer decoded speech signal power calculation section 551, the extended layer power ratio input from extended layer power ratio calculation section 552, and threshold values B and C input from extended layer minute-power determination threshold value storage section 553, extended layer minute-power interval determination section 554 obtains extended layer minute-power interval determination result d(t) in accordance with Equation (9) below. As a permissible interval includes an extended layer minute-power interval, the extended layer minute-power interval determination result is here represented by d(t), the same as a permissible interval detection result. Extended layer minute-power interval determination section 554 outputs extended layer minute-power interval determination result d(t) to permissible interval determination section 506.

(Equation 9)

$$d(t) = \begin{cases} 1, & Pe(t) < B \\ 1, & \dfrac{Pe(t)}{Pc(t)} < C \\ 0, & \text{etc.} \end{cases} \quad [9]$$

When permissible interval detection section 110 detects a permissible interval by means of the above-described method, weighted addition section 114 then changes the mixing ratio comparatively rapidly only in an interval in which a speech signal band change is difficult to perceive, and changes the mixing ratio comparatively gradually in an interval in which a speech signal band change is easily perceived. Thus, the possibility of a listener experiencing a disagreeable sensation or a sense of fluctuation with respect to a speech signal can be dependably reduced.

Figure 2:
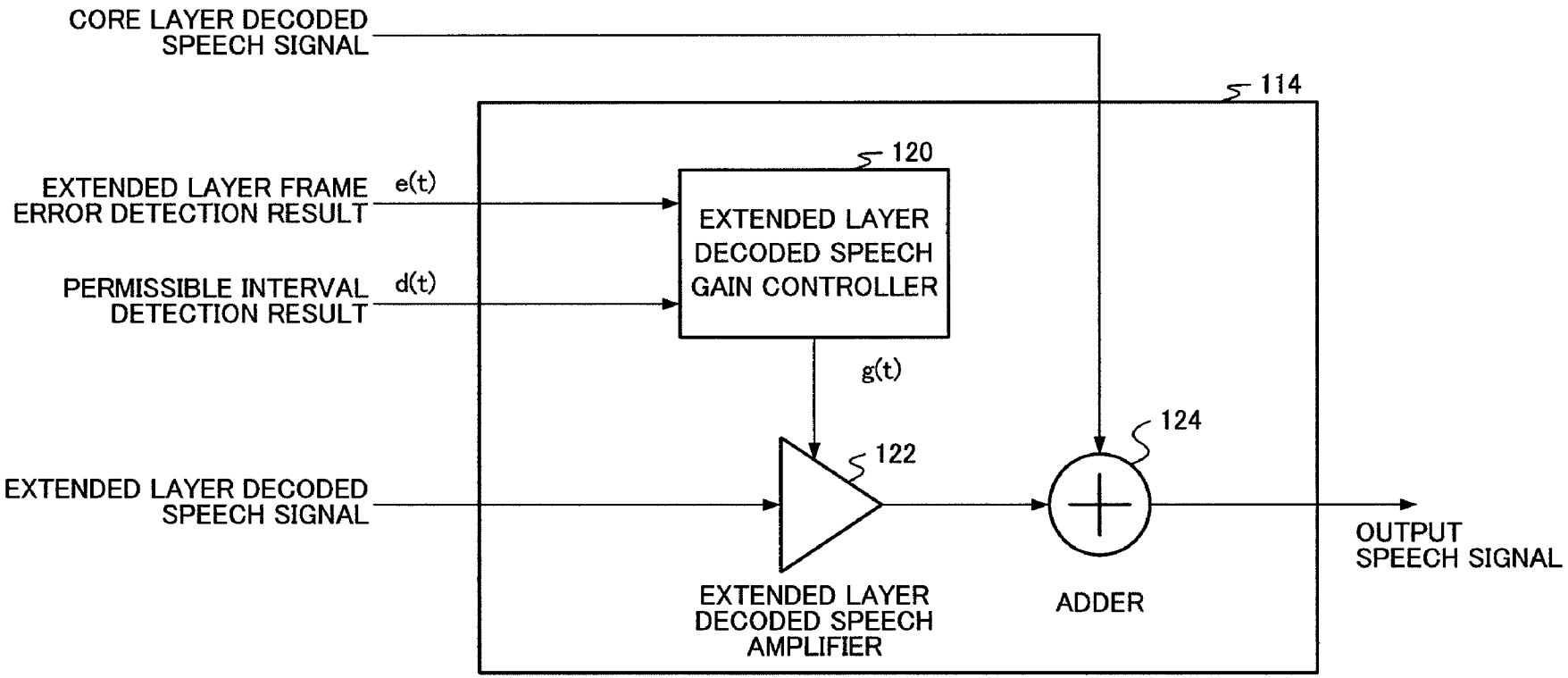
FIG. 2 is a block diagram showing the configuration of a weighted addition section according to an embodiment of the present invention.

Next, the internal configuration and operation of weighted addition section 114 will be described using FIG. 2. FIG. 2 is a block diagram showing the configuration of weighted addition section 114. Weighted addition section 114 has an extended layer decoded speech gain controller 120, an extended layer decoded speech amplifier 122, and an adder 124.

Extended layer decoded speech gain controller 120, serving as a setting section, controls extended layer decoded speech signal gain (hereinafter referred to as "extended layer gain") based on an extended layer frame error detection result and permissible interval detection result. In extended layer decoded speech signal gain control, the degree of change over time of extended layer decoded speech signal gain is set variably. By this means, the mixing ratio when a core layer decoded speech signal and extended layer decoded speech signal are mixed is set variably.

Control of core layer decoded speech signal gain (hereinafter referred to as "core layer gain") is not performed by extended layer decoded speech gain controller 120, and the gain of a core layer decoded speech signal when mixed with an extended layer decoded speech signal is fixed at a constant value. Therefore, the mixing ratio can be set variably more easily than when the gain of both signals is set variably. Nevertheless, core layer gain may also be controlled, rather than controlling only extended layer gain.

Extended layer decoded speech amplifier 122 multiplies gain controlled by extended layer decoded speech gain controller 120 by an extended layer decoded speech signal input from extended layer decoding section 108. The extended layer decoded speech signal multiplied by the gain is output to adder 124.

Adder 124 adds together the extended layer decoded speech signal input from extended layer decoded speech amplifier 122 and a core layer decoded speech signal input from signal adjustment section 112. By this means, the core layer decoded speech signal and extended layer decoded speech signal are mixed, and a mixed signal is generated. The generated mixed signal becomes the speech decoding apparatus 100 output speech signal. That is to say, the combination of extended layer decoded speech amplifier 122 and adder 124 constitutes a mixing section that mixes a core layer decoded speech signal and extended layer decoded speech signal while changing the mixing ratio of the core layer decoded speech signal and extended layer decoded speech signal over time, and obtains a mixed signal.

The operation of weighted addition section 114 is described below.

Extended layer gain is controlled by extended layer decoded speech gain controller 120 of weighted addition section 114 so that, principally, it is attenuated when extended layer coded data cannot be received, and rises when extended layer coded data starts to be received. Also, extended layer gain is controlled adaptively in synchronization with the state of the core layer decoded speech signal or extended layer decoded speech signal.

An example of extended layer gain variable setting operation by extended layer decoded speech gain controller 120 will now be described. In this embodiment, since core layer decoded speech signal gain is fixed, when extended layer gain and its degree of change over time are changed by extended layer decoded speech gain controller 120, the mixing ratio of a core layer decoded speech signal and extended layer decoded speech signal, and the degree of change over time of that mixing ratio, are changed.

Extended layer decoded speech gain controller 120 determines extended layer gain g(t) using extended layer frame error detection result e(t) input from extended layer frame error detection section 106 and permissible interval detection result d(t) input from permissible interval detection section 110. Extended layer gain g(t) is determined by means of following Equations (10) through (12).

$$g(t)=1.0, \text{ when } g(t-1)+s(t)>1.0 \quad \text{(Equation 10)}$$

$$g(t)=g(t-1)+s(t), \text{ when } 0.0 \leqq g(t-1)+s(t) \leqq 1.0 \quad \text{(Equation 11)}$$

$$g(t)=0.0, \text{ when } g(t-1)+s(t)<0.0 \quad \text{(Equation 12)}$$

Here, s(t) denotes the extended layer gain increment/decrement value.

That is to say, the minimum value of extended layer gain g(t) is 0.0, and the maximum value is 1.0. Since core layer gain is not controlled—that is, core layer gain is always 1.0—when g(t)=1.0, a core layer decoded speech signal and extended layer decoded speech signal are mixed using a 1:1 mixing ratio. On the other hand, when g(t)=0.0, the core layer decoded speech signal output from signal adjustment section 112 becomes the output speech signal.

Increment/decrement value s(t) is determined by means of following Equations (13) through (16) in accordance with extended layer frame error detection result e(t) and permissible interval detection result d(t).

$$s(t)=0.20, \text{ when } e(t)=1 \text{ and } d(t)=1 \quad \text{(Equation 13)}$$

$$s(t)=0.02, \text{ when } e(t)=1 \text{ and } d(t)=0 \quad \text{(Equation 14)}$$

$$s(t)=-0.40, \text{ when } e(t)=0 \text{ and } d(t)=1 \quad \text{(Equation 15)}$$

$$s(t)=-0.20, \text{ when } e(t)=0 \text{ and } d(t)=0 \quad \text{(Equation 16)}$$

Extended layer frame error detection result e(t) is indicated by following Equations (17) and (18).

$$e(t)=1, \text{ when there is no extended layer frame error} \quad \text{(Equation 17)}$$

$$e(t)=0, \text{ when there is an extended layer frame error} \quad \text{(Equation 18)}$$

permissible interval detection result d(t) is indicated by following Equations (19) and (20).

$$d(t)=1, \text{ in case of a permissible interval} \quad \text{(Equation 19)}$$

$$d(t)=0, \text{ in case of an interval other than a permissible interval} \quad \text{(Equation 20)}$$

Comparing Equation (13) and Equation (14), or comparing Equation (15) and Equation (16), extended layer gain increment/decrement value s(t) is larger for a permissible interval (d(t)=1) than for an interval other than a permissible interval (d(t)=0). Therefore, in a permissible interval, the degree of change over time of the mixing ratio of a core layer decoded speech signal and extended layer decoded speech signal is greater, and the change over time of the mixing ratio is more rapid, than in an interval other than a permissible interval. Thus, in an interval other than a permissible interval, the degree of change over time of the mixing ratio of a core layer decoded speech signal and extended layer decoded speech signal is smaller, and the change over time of the mixing ratio is more gradual, than in a permissible interval.

To simplify the explanation, above functions g(t), s(t), and d(t) have been expressed in frame units, but they may also be expressed in sample units. Also, the numeric values used in above Equations (10) through (20) are only examples, and other numeric values may be used. In the above examples, functions whereby extended layer gain increases or decreases linearly have been used, but any function can be used that monotonically increases or monotonically decreases extended layer gain. Also, when a background noise signal is included in a core layer decoded speech signal, the speech signal to background noise signal ratio or the like may be found using the core layer decoded speech signal, and the extended layer gain increment or decrement may be controlled adaptively according to that ratio.

Figures 3, 3A, 3B, 3C:
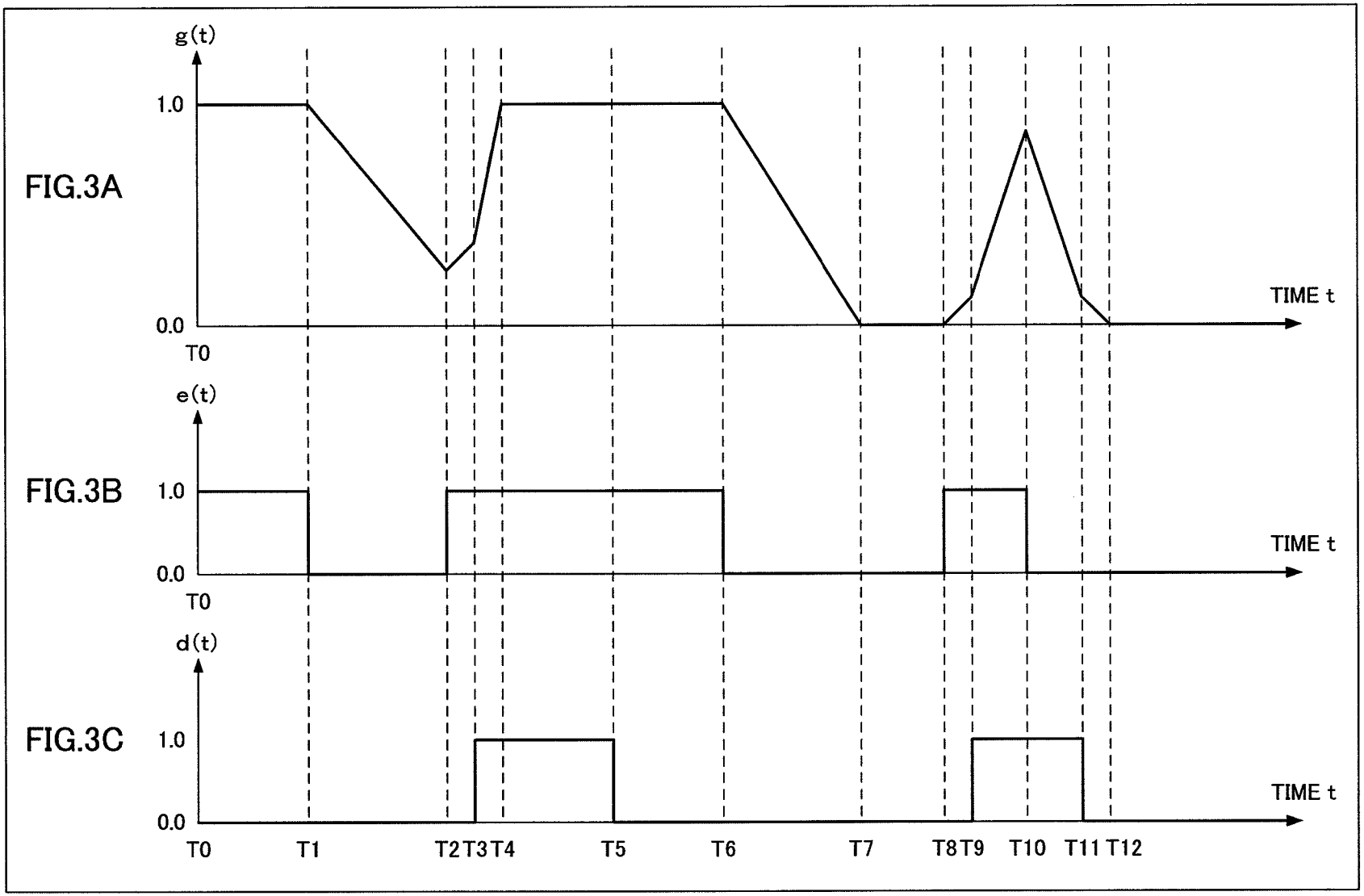
FIG. 3 is a drawing for explaining an example of change over time of extended layer gain according to an embodiment of the present invention.
Figure 4:
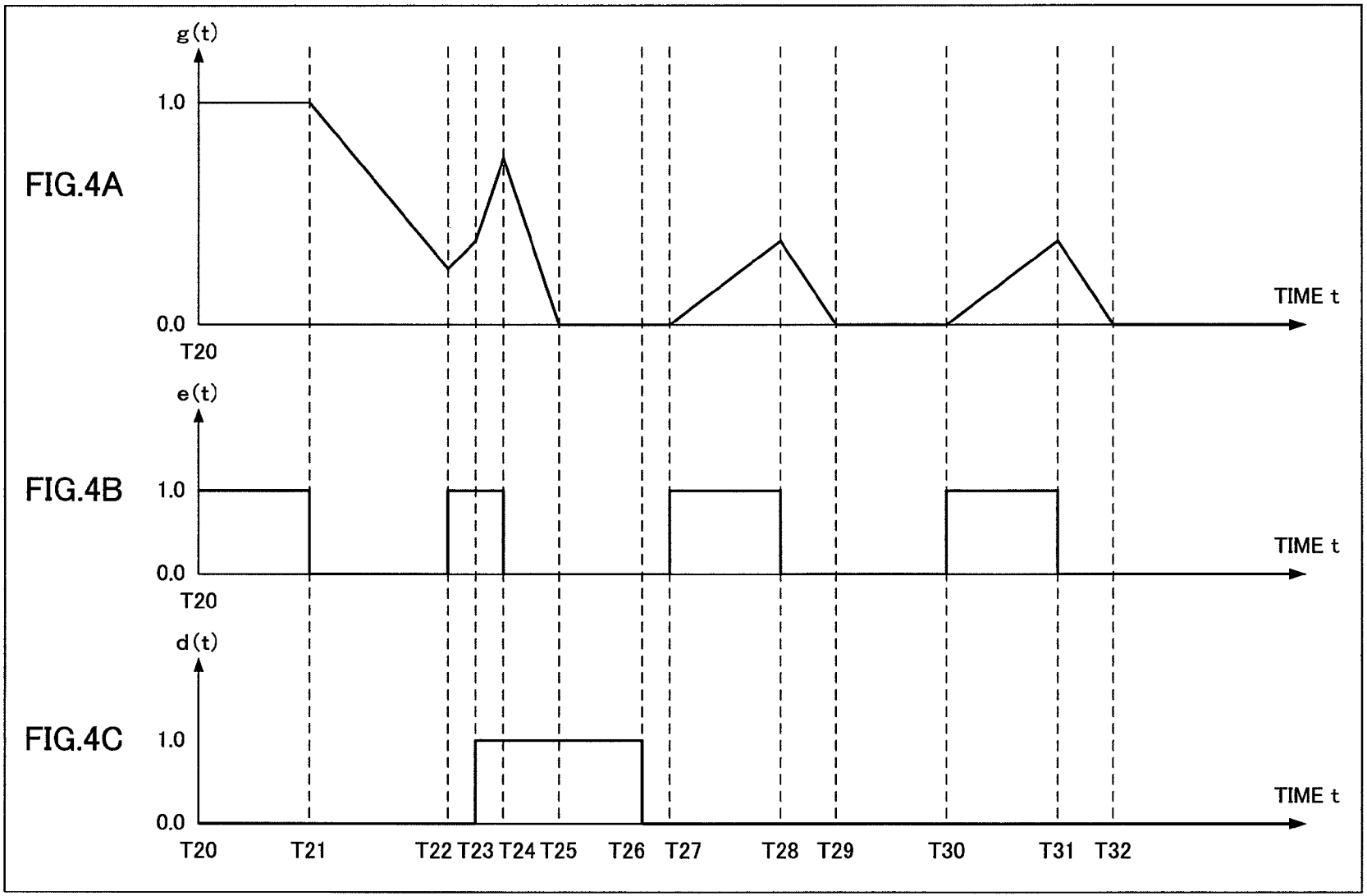
FIG. 4 is a drawing for explaining another example of change over time of extended layer gain according to an embodiment of the present invention.

Next, change over time of extended layer gain controlled by extended layer decoded speech gain controller 120 will be explained by giving two examples. FIG. 3 is a drawing for explaining a first example of change over time of extended layer gain, and FIG. 4 is a drawing for explaining a second example of change over time of extended layer gain.

First, the first example will be explained using FIG. 3. FIG. 3B shows whether or not it has been possible to receive extended layer coded data. An extended layer frame error has been detected in the interval from time T1 to time T2, the interval from time T6 to time T8, and the interval from time T10 onward, whereas an extended layer frame error has not been detected in intervals other than these.

FIG. 3C shows permissible interval detection results. The interval from time T3 to time T5 and the interval from time T9 to time T11 are detected permissible intervals. A permissible interval has not been detected in intervals other than these.

FIG. 3A shows extended layer gain. Here, g(t)=0.0 indicates that an extended layer decoded speech signal is completely attenuated and does not contribute to output at all, whereas g(t)=1.0 indicates that the extended layer decoded speech signal is fully utilized.

In the interval from time T1 to time T2, extended layer gain gradually falls because an extended layer frame error has been detected. When time T2 is reached, extended layer gain rises because an extended layer frame error is no longer detected. In the extended layer gain rise period from time T2 onward, the interval from time T2 to time T3 is not a permissible interval. Therefore, the degree of rise of extended layer gain is small, and the rise of extended layer gain is comparatively gradual. On the other hand, in the extended layer gain rise period from time T2 onward, the interval from time T3 to time T5 is a permissible interval. Therefore, the degree of rise of extended layer gain is large, and the rise of extended layer gain is comparatively rapid. By this means, a band change can be prevented from being perceived in the interval from time T2 to time T3. Also, in the interval from time T3 to time T5, a band change can be speeded up while maintaining a state in which a band change is difficult to perceive, a contribution can be made to providing a wide-band sensation, and subjective quality can be improved.

Then, in the interval from time T8 to time T10, extended layer gain rises because an extended layer frame error has not been detected. However, in the interval from time T8 to time T10, the interval from time T8 to time T9 is not a permissible interval. Therefore, the rise of extended layer gain is kept comparatively gradual. On the other hand, in the interval from time T8 to time T10, the interval from time T9 to time T10 is a permissible interval. Therefore, the rise of extended layer gain is comparatively rapid.

Then, in the interval from time T10 onward, an extended layer frame error has been detected, and therefore the change in extended layer gain becomes a fall from time T10 onward. Also, in the interval from time T10 onward, the interval from time T10 to time T11 is a permissible interval. Therefore, the degree of fall of extended layer gain is large, and the fall of extended layer gain is comparatively rapid. On the other hand, the interval from T11 onward is a permissible interval, and therefore the degree of fall of extended layer gain is small, and the fall of extended layer gain is kept comparatively gradual. Then, at time T12, extended layer gain becomes 0.0. By this means, in the interval from time T10 to time T11, a band change can be speeded up while maintaining a state in which a band change is difficult to perceive. Also, in the interval from time T11 to time T12, the band change can be prevented from being perceived.

Next, the second example will be explained using FIG. 4. FIG. 4B shows whether or not it has been possible to receive extended layer coded data. An extended layer frame error has been detected in the interval from time T21 to time T22, the interval from time T24 to time T27, the interval from time T28 to time T30, and the interval from time T31 onward, whereas an extended layer frame error has not been detected in intervals other than these.

FIG. 4C shows permissible interval detection results. The interval from time T23 to time T26 is a detected permissible interval. A permissible interval has not been detected in intervals other than this.

FIG. 4A shows extended layer gain. In this second example, the frequency with which extended layer frame errors are detected is higher than in the first example. Therefore, the frequency of reversal of extended layer gain incrementing/decrementing is also higher. Specifically, extended layer gain rises from time T22, falls from time T24, rises from time T27, falls from time T28, rises from time T30, and falls from time T31. During the course of these rises and falls, only the interval from time T23 to time T26 is a permissible interval. That is to say, in the interval from time T26 onward, the degree of change of extended layer gain is controlled so as to be small, and changes in extended layer gain are kept comparatively gradual. Consequently, the rises of extended layer gain in the interval from time T27 to time T28 and the interval from time T30 to time T31 are comparatively gradual, and the falls of extended layer gain in the interval from time T28 to time T29 and the interval from time T31 to time T32 are comparatively gradual. By this means, a listener can be prevented from experiencing a sense of fluctuation due to the frequency of band changes.

Thus, in the above two examples, changes in core layer decoded speech signal power and so forth, and a general sense of fluctuation in decoded speech that may arise from band switching, can be alleviated by performing band switching rapidly in a permissible interval. On the other hand, in intervals other than permissible intervals, bandwidth changes can be prevented from being noticeable by performing power and bandwidth changes gradually.

Also, in the above two examples, the mixed signal output time is changed as the degree of change over time of extended layer gain is changed. Consequently, the occurrence of discontinuity of sound volume or discontinuity of band sensation can be prevented when the degree of change over time of the mixing ratio is changed.

As described above, according to this embodiment, the degree of change of a mixing ratio that changes over time when a core layer decoded speech signal—that is, a narrow-band speech signal—and an extended layer decoded speech signal—that is, a wide-band speech signal—are mixed is set variably, enabling the possibility of a listener experiencing a disagreeable sensation or a sense of fluctuation with respect to a speech signal to be reduced, and sound quality to be improved.

The usable band scalable speech coding method is not limited to that described in this embodiment. For example, the configuration of this embodiment can also be applied to a method whereby a wide-band decoded speech signal is decoded in one operation using both core layer coded data and extended layer coded data in the extended layer, and the core layer decoded speech signal is used in the event of an extended layer frame error. In this case, when core layer decoded speech and extended layer decoded speech are switched, overlapped addition processing is executed that performs feed-in or feed-out for both the core layer decoded speech and the extended layer decoded speech. Then the speed of feed-in or feed-out is controlled in accordance with the above-described permissible interval detection results. By this means, decoded speech in which sound quality degradation is suppressed can be obtained.

A configuration for detecting an interval for which band changing is permitted, in the same way as permissible interval detection section 110 of this embodiment, may be provided in a speech coding apparatus that uses a band scalable speech coding method. In this case, the speech coding apparatus defers band switching (that is, switching from a narrow band to a wide band or switching from a wide band to a narrow band) in an interval other than an interval for which band changing is permitted, and executes band switching only in an interval for which band changing is permitted. When speech coded by this speech coding apparatus is decoded by a speech decoding apparatus, the possibility of a listener experiencing a disagreeable sensation or a sense of fluctuation with respect to the decoded speech can still be reduced even if that speech decoding apparatus does not have a band switching function.

The function blocks used in the description of the above embodiment are typically implemented as LSIs, which are integrated circuits. These may be implemented individually as single chips, or a single chip may incorporate some or all of them.

Here, the term LSI has been used, but the terms IC, system LSI, super LSI, and ultra LSI may also be used according to differences in the degree of integration.

The method of implementing integrated circuitry is not limited to LSI, and implementation by means of dedicated circuitry or a general-purpose processor may also be used. An FPGA (Field Programmable Gate Array) for which programming is possible after LSI fabrication, or a reconfigurable processor allowing reconfiguration of circuit cell connections and settings within an LSI, may also be used.

In the event of the introduction of an integrated circuit implementation technology whereby LSI is replaced by a different technology as an advance in, or derivation from, semiconductor technology, integration of the function blocks may of course be performed using that technology. The adaptation of biotechnology or the like is also a possibility.

A first aspect of the present invention is a speech switching apparatus that outputs a mixed signal in which a narrow-band speech signal and wide-band speech signal are mixed when switching the band of an output speech signal, and employs a configuration that includes a mixing section that mixes the narrow-band speech signal and the wide-band speech signal while changing the mixing ratio of the narrow-band speech signal and the wide-band speech signal over time, and obtains the mixed signal, and a setting section that variably sets the degree of change over time of the mixing ratio.

According to this configuration, since the degree of change of a mixing ratio that changes over time when a narrow-band speech signal and a wide-band speech signal are mixed is set variably, the possibility of a listener experiencing a disagreeable sensation or a sense of fluctuation with respect to a speech signal can be reduced, and sound quality can be improved.

A second aspect of the present invention employs a configuration wherein, in the above configuration, a detection section is provided that detects a specific interval in a period in which the narrow-band speech signal or the wide-band speech signal is obtained, and the setting section increases the degree when the specific interval is detected, and decreases the degree when the specific interval is not detected.

According to this configuration, a period in which the degree of change over time of the mixing ratio is made comparatively high can be limited to a specific interval within a period in which a speech signal is obtained, and the timing at which the degree of change over time of the mixing ratio is changed can be controlled.

A third aspect of the present invention employs a configuration wherein, in an above configuration, the detection section detects an interval for which a rapid change of a predetermined level or above of the band of the speech signal is permitted as the specific interval.

A fourth aspect of the present invention employs a configuration wherein, in an above configuration, the detection section detects a silent interval as the specific interval.

A fifth aspect of the present invention employs a configuration wherein, in an above configuration, the detection section detects an interval in which the power of the narrow-band speech signal is at or below a predetermined level as the specific interval.

A sixth aspect of the present invention employs a configuration wherein, in an above configuration, the detection section detects an interval in which the power of the wide-band speech signal is at or below a predetermined level as the specific interval.

A seventh aspect of the present invention employs a configuration wherein, in an above configuration, the detection section detects an interval in which the magnitude of the power of the wide-band speech signal with respect to the power of the narrow-band speech signal is at or below a predetermined level as the specific interval.

An eighth aspect of the present invention employs a configuration wherein, in an above configuration, the detection section detects an interval in which fluctuation of the power of the narrow-band speech signal is at or above a predetermined level as the specific interval.

A ninth aspect of the present invention employs a configuration wherein, in an above configuration, the detection section detects a rise of the narrow-band speech signal as the specific interval.

A tenth aspect of the present invention employs a configuration wherein, in an above configuration, the detection section detects an interval in which fluctuation of the power of the wide-band speech signal is at or above a predetermined level as the specific interval.

An eleventh aspect of the present invention employs a configuration wherein, in an above configuration, the detection section detects a rise of the wide-band speech signal.

A twelfth aspect of the present invention employs a configuration wherein, in an above configuration, the detection section detects an interval in which the type of background noise signal included in the narrow-band speech signal changes as the specific interval.

A thirteenth aspect of the present invention employs a configuration wherein, in an above configuration, the detection section detects an interval in which the type of background noise signal included in the wide-band speech signal changes as the specific interval.

A fourteenth aspect of the present invention employs a configuration wherein, in an above configuration, the detection section detects an interval in which change of a spectrum parameter of the narrow-band speech signal is at or above a predetermined level as the specific interval.

A fifteenth aspect of the present invention employs a configuration wherein, in an above configuration, the detection section detects an interval in which change of a spectrum parameter of the wide-band speech signal is at or above a predetermined level as the specific interval.

A sixteenth aspect of the present invention employs a configuration wherein, in an above configuration, the detection section detects an interval after interpolation processing has been performed on the narrow-band speech signal as the specific interval.

A seventeenth aspect of the present invention employs a configuration wherein, in an above configuration, the detection section detects an interval after interpolation processing has been performed on the wide-band speech signal as the specific interval.

According to these configurations, the mixing ratio can be changed comparatively rapidly only in an interval in which a speech signal band change is difficult to perceive, and the mixing ratio can be changed comparatively gradually in an interval in which a speech signal band change is easily perceived, and the possibility of a listener experiencing a disagreeable sensation or a sense of fluctuation with respect to a speech signal can be dependably reduced.

An eighteenth aspect of the present invention employs a configuration wherein, in an above configuration, the setting section fixes the gain of the narrow-band speech signal, but variably sets the degree of change over time of the gain of the wide-band speech signal.

According to this configuration, variable setting of the mixing ratio can be performed more easily than when the degree of change over time of the gain of both signals is set variably.

A nineteenth aspect of the present invention employs a configuration wherein, in an above configuration, the setting section changes the output time of the mixed signal.

According to this configuration, the occurrence of discontinuity of sound volume or discontinuity of band sensation can be prevented when the degree of change over time of the mixing ratio of both signals is changed.

A twentieth aspect of the present invention is a communication terminal apparatus that employs a configuration equipped with a speech switching apparatus of an above configuration.

A twenty-first aspect of the present invention is a speech switching method that outputs a mixed signal in which a narrow-band speech signal and wide-band speech signal are mixed when switching the band of an output speech signal, and has a changing step of changing the degree of change over time of the mixing ratio of the narrow-band speech signal and the wide-band speech signal, and a mixing step of mixing the narrow-band speech signal and the wide-band speech signal while changing the mixing ratio over time to the changed degree, and obtaining the mixed signal.

According to this method, since the degree of change of a mixing ratio that changes over time when a narrow-band speech signal and a wide-band speech signal are mixed is set variably, the possibility of a listener experiencing a disagreeable sensation or a sense of fluctuation with respect to a speech signal can be reduced, and sound quality can be improved.

The present application is based on Japanese Patent Application No. 2005-008084 filed on Jan. 14, 2005, entire content of which is expressly incorporated herein by reference.

INDUSTRIAL APPLICABILITY

A speech switching apparatus and speech switching method of the present invention can be applied to speech signal band switching.

The invention claimed is:

1. A speech switching apparatus that includes outputs a mixed signal in which a narrow-band speech signal and a wide-band speech signal are mixed when switching a band of an output speech signal, the apparatus comprising:

a processor, the processor comprising:

a detector that detects a specific interval in a period in which the narrow-band speech signal or the wide-band speech signal is obtained;

a mixer that mixes the narrow-band speech signal and the wide-band speech signal while changing a mixing ratio of the narrow-band speech signal and the wide-band speech signal over time, and obtains the mixed signal; and a setter that varies a degree of change over time of the mixing ratio as a function of the detected specific interval.

2. The speech switching apparatus according to claim 1, wherein the setter increases the degree of change when the specific interval is detected, and decreases the degree of change when the specific interval is not detected.

3. The speech switching apparatus according to claim 1, wherein the detector detects an interval, in which an abrupt change of a predetermined level or above of a band of the speech signal is permitted, as the specific interval.

4. The speech switching apparatus according to claim 1, wherein the detector detects a silent interval as the specific interval.

5. The speech switching apparatus according to claim 1, wherein the detector detects an interval, in which power of the narrow-band speech signal is at or below a predetermined level, as the specific interval.

6. The speech switching apparatus according to claim 1, wherein the detector detects an interval, in which power of the wide-band speech signal is at or below a predetermined level, as the specific interval.

7. The speech switching apparatus according to claim 1, wherein the detector detects an interval, in which magnitude of power of the wide-band speech signal with respect to power of the narrow-band speech signal is at or below a predetermined level, as the specific interval.

8. The speech switching apparatus according to claim 1, wherein the detector detects an interval, in which fluctuation of power of the narrow-band speech signal is at or above a predetermined level, as the specific interval.

9. The speech switching apparatus according to claim 1, wherein the detector detects a rise of the narrow-band speech signal as the specific interval.

10. The speech switching apparatus according to claim 1, wherein the detector detects an interval, in which fluctuation of power of the wide-band speech signal is at or above a predetermined level, as the specific interval.

11. The speech switching apparatus according to claim 1, wherein the detector detects a rise of the wide-band speech signal.

12. The speech switching apparatus according to claim 1, wherein the detector detects an interval, in which a type of background noise signal included in the narrow-band speech signal changes, as the specific interval.

13. The speech switching apparatus according to claim 1, wherein the detector detects an interval, in which a type of background noise signal included in the wide-band speech signal changes, as the specific interval.

14. The speech switching apparatus according to claim 1, wherein the detector detects an interval, in which change in a spectrum parameter of the narrow-band speech signal is at or above a predetermined level, as the specific interval.

15. The speech switching apparatus according to claim 1, wherein the detector detects an interval, in which change in a spectrum parameter of the wide-band speech signal is at or above a predetermined level, as the specific interval.

16. The speech switching apparatus according to claim 1, wherein the detector detects an interval after interpolation processing has been performed on the narrow-band speech signal, as the specific interval.

17. The speech switching apparatus according to claim 1, wherein the detector detects an interval after interpolation processing has been performed on the wide-band speech signal, as the specific interval.

18. The speech switching apparatus according to claim 1, wherein the setter fixes a gain of the narrow-band speech signal, and variably sets a degree of change over time of a gain of the wide-band speech signal.

19. The speech switching apparatus according to claim 1, wherein the setter changes an output time of the mixed signal.

20. A communication terminal apparatus comprising the speech switching apparatus according to claim 1.

21. A speech switching method that outputs a mixed signal in which a narrow-band speech signal and a wide-band speech signal are mixed when switching a band of an output speech signal, comprising:

detecting a specific interval in a period in which the narrow-band speech signal or the wide-band speech signal is obtained, changing a degree of change over time of a mixing ratio of the narrow-band speech signal and the wide-band speech signal between the detected specific interval and a period other than the specific interval; and mixing the narrow-band speech signal and the wide-band speech signal while changing the degree of change of mixing ratio over time as a function of the detected specific interval, and obtaining the mixed signal.

* * * * *